United States Patent [19]

Carleton, Jr.

[11] Patent Number: 4,647,923

[45] Date of Patent: Mar. 3, 1987

[54] TRUE OBJECT GENERATION SYSTEM AND METHOD FOR A VIDEO DISPLAY GENERATOR

[75] Inventor: William F. Carleton, Jr., Chandler, Ariz.

[73] Assignee: Motorola, Inc., Schaumburg, Ill.

[21] Appl. No.: 864,367

[22] Filed: May 19, 1986

Related U.S. Application Data

[63] Continuation of Ser. No. 551,814, Nov. 15, 1983, abandoned.

[51] Int. Cl.[4] ..... G09G 1/14

[52] U.S. Cl. ..... 340/723; 340/703; 340/800; 358/261

[58] Field of Search ..... 340/703, 721, 723, 800; 434/20, 43; 273/85 G, DIG. 28; 358/261

[56] References Cited

U.S. PATENT DOCUMENTS 4,169,272 9/1979 Rains et al. ..... 273/DIG. 28
4,233,601 11/1980 Hankins et al. ..... 340/703

OTHER PUBLICATIONS

"Flag Run-Length Coded Data Format", *IBM Technical Disclosure Bulletin*, vol. 15, No. 12, May, 1973, Min et al.

*Primary Examiner*—Gerald L. Brigance
*Attorney, Agent, or Firm*—Dale E. Jepsen

[57] ABSTRACT

A true object generation system for true object generation in a video display generator or video display generator which comprises means for storage of data representative of an object run length and pel value and means responsive to the object run length data for holding the pel value at the storage means output for a time proportional to the object run length. True objects may be generated by either a run length or bit mapped code structure.

11 Claims, 3 Drawing Figures

VDD
CLR
S/L
CK
INH
QH
SI
H
G
F
E
D
C
B
A
Y0
Y1
Y2
Y3
1B
1A
1G
S
1Y
2Y
1B
2B
1A
2A
G
R
1Q
2Q
1D
2D
T
P
U/D
A
B
C
D
QA
QB
QC
QD
L
D4
D5
D6
D7
D0
D1
D2
D3
C
B
A
W
Y
S
QG
SR
CLR
S0
S1
G1
G2
10

| | | | | RUN LENGTH | | | DATA |
|---|---|---|---|---|---|---|---|
| $\overline{LL}$ | CMRO 3 | CMRO 2 | CMRO 1 | P | E | L | 1 |
| P | E | L | 2 | P | E | L | 3 |
| P | E | L | 4 | P | E | L | 5 |
| P | E | L | 6 | P | E | L | 7 |

RUN LENGTH CODE STRUCTURE

FIG. 2A

| | | | | | |
|---|---|---|---|---|---|
| $\overline{LL}$ | CMRO 3 | CMRO 2 | CMRO 1 | PEL 1 | PEL 2 |
| PEL 3 | | PEL 4 | | PEL 5 | PEL 6 |
| PEL 7 | | PEL 8 | | PEL 9 | PEL 10 |
| PEL 11 | | PEL 12 | | PEL 13 | PEL 14 |

BIT MAPPED CODE STRUCTURE

FIG. 2B

TRUE OBJECT GENERATION SYSTEM AND METHOD FOR A VIDEO DISPLAY GENERATOR

This is a continuation of application Ser. No. 551,814, filed Nov. 15, 1983, now abandoned.

BACKGROUND OF THE INVENTION

The present invention relates, in general, to the field of true object generation in a video display generator. More particularly, the present invention relates to a true object generation system and method of especial utility in the generation of true objects in conjunction with a microprocessor (MPU) based video display generator.

True objects are video display generator hardware-intensive objects which are designed to move around on a video display screen and to run into, or collide with, other objects. Such true objects comprise a small video pattern which is stored in a particular location in the memory of a video display generator. These true objects can be positioned on the screen independently of where they are stored in memory merely by defining its vertical and horizontal position. By the use of true objects then, a video display screen may be easily animated and the object stored in the particular location in memory may be made to move across the screen merely by changing its start address.

In general, in a video display generator there is a vertical address comparator and a horizontal address comparator. During a vertical line count, one comparator looks at the actual line count as the Raster moves down the video display screen. A comparison is made to the position of each object and a signal is generated that describes a vertical "go" signal as a time for a true object to start. An identical operation happens horizontally where the horizontal position and horizontal picture element (pel) count across the screen generates a signal for a horizontal "go". These two signals are ANDed together to provide a signal to begin generation of a true object.

In the past, true objects have been generated by a technique known as bit mapping. Utilizing this method of encoding, an object size is limited by the amount of hardware, or registers, in which this data may be stored for retrieval. In an integrated video display generator, the number and size of these registers is directly related to die size and, hence, system cost. Moreover, the time necessary to fill these registers from the video display generator DRAM and, therefore, system operating speed is also directly related to the amount of memory which must be read into these registers. Therefore, it is highly desirable to limit the size of the registers and the time necessary to fill them.

Run length coding has previously been described as a means for generating a background display in a video generator. A representative system is described in U.S. Pat. No. 4,233,601 issued to Hankins et al on Nov. 11, 1980 for a display system. This patent describes a means of generating a Raster Display using run length encoded data. However, its application is to the entire Raster Display and not to the generation of true object data.

SUMMARY OF THE INVENTION

It is therefore an object of the present invention to provide an improved system and method for generation of true objects in a video display generator.

It is further an object of the present invention to provide an improved system and method for generation of true objects by means of run length coding which minimizes on-chip hardware storage area and, hence, access time for a given object size.

It is still further an object of the present invention to provide an improved system and method for generation of true objects which provides for either bit mapped or run length code structures.

The foregoing and other objects are achieved in the present invention wherein there is provided a true object generation system and method for true object generation in a video display generator which comprises means for storage of data representative of an object run length and pel value. Means are also provided responsive to the object run length data for holding the pel value at the storage means output for a time proportional to the object run length.

In a specific application, a true object generation system and method for true object generation in a video display generator comprises a shift register for receiving data representative of an object run length and pel value. Means are provided which are responsive to the object run length for establishing a count value proportional thereto. Means are further provided which are responsive to the count value establishing means for decrementing from the count value. The decrementing means applies a hold signal to the shift register during a countdown from the hold value and a shift signal to the shift register when the countdown is complete.

BRIEF DESCRIPTION OF THE DRAWINGS

The above-mentioned and other features and objects of the invention and the manner of attaining them will become more apparent and the invention itself will be best understood by reference to the following description of an embodiment of the invention taken in conjunction with the accompanying drawings, wherein:

FIG. 2A illustrates a run length code structure for use with the embodiment of FIG. 1 and the generation of true objects by run length coding; and FIG. 2B illustrates a bit mapped code structure for use with the embodiment of FIG. 1 and the generation of true objects by bit mapped coding.

DESCRIPTION OF A PREFERRED EMBODIMENT

Figure 1:
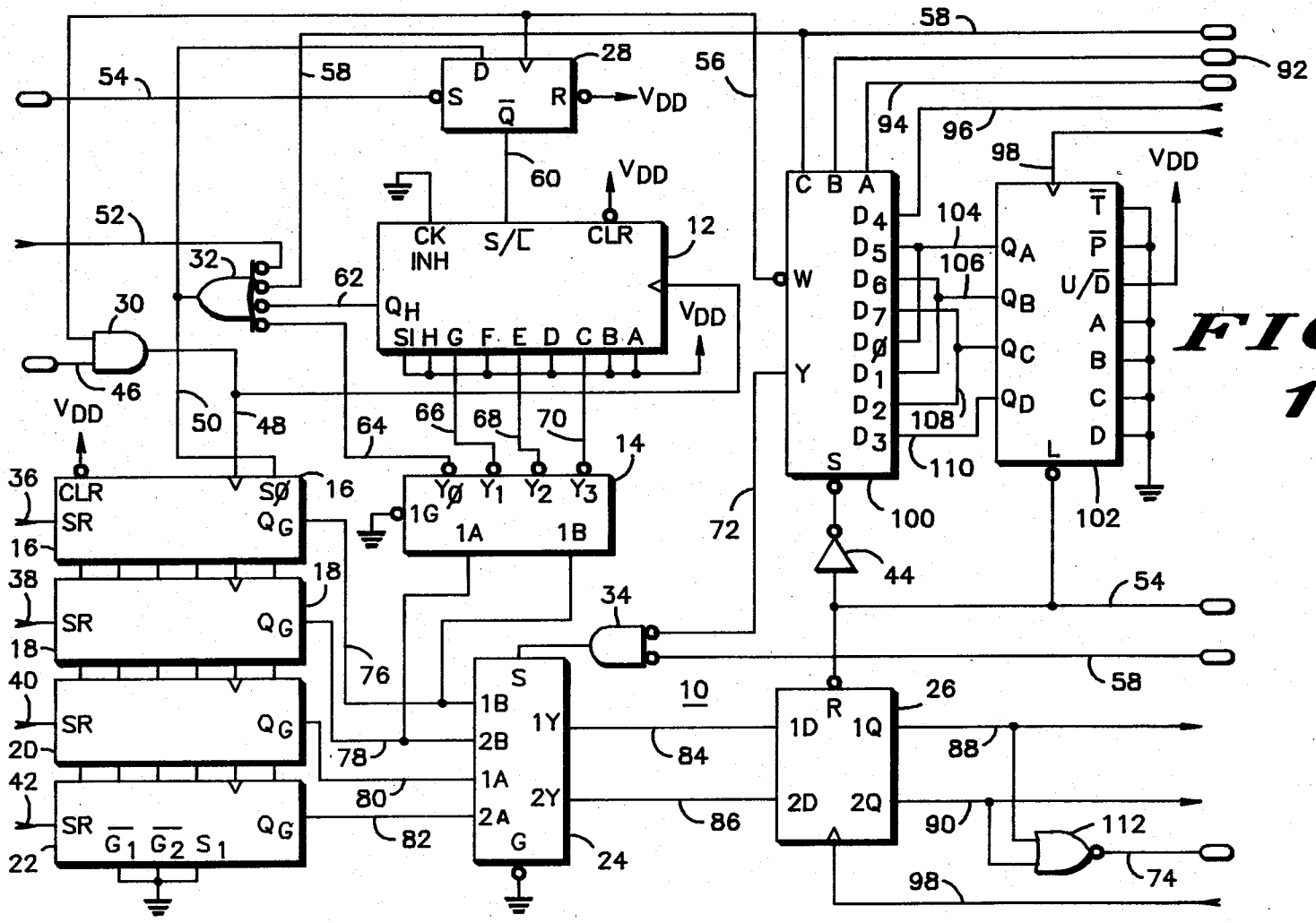
FIG. 1 is a simplified logic flow diagram of a true object generation system in accordance with the present invention which allows for both bit mapped and run length coding of true object generation in a video display generator.

The run length coding system and method of the present invention is intended for use in a video display generator or microprocessor controlled video display generator system having an associated memory array. For purposes of the ensuing description, the terms "pixel" and "pel" may both mean picture element. Traditionally, pixel refers to the smallest physical picture element, which is the resolution of the cathode ray tube (CRT) being used, and "pel" refers to the smallest logical picture element, which is set by the rest of the video system. In this description, the term "pixel" will mean the element set by the horizontal and vertical screen resolutions, and "pel" will be used to refer to all other picture elements. Further, the video display generator with which the run length coding system and method of the present invention may be utilized, uses a block of DRAM as a "screen memory" to contain the display information.

True objects are video display generator hardware intensive objects that are designed to move around on a display screen and to interact with other objects. Identical run lenth coding systems to that hereinafter described are utilized with each independent object which is to be displayed on a video screen. Thus, identical sets of run length coding systems in accordance with the present invention will allow for simultaneous independent operations of the true objects. However, since objects may be reused in real time, more objects may appear on a screen than the number of run length coding systems supplied although they may not appear in the same Raster line.

Referring now to FIG. 1, a run length coding system 10 in accordance with the present invention is shown. Data input to run length coding system 10 from a video display generator DRAM is input on high nibble MSB line 36, low nibble MSB line 38, high nibble LSB line 40 and low nibble LSB line 42 to the data input terminals, SR, of MSB shift register 16, MSB shift register 18, LSB shift register 20 and LSB shift register 22 respectively. MSB shift registers 16, 18 and LSB shift registers 20, 22 are connected in parallel, as shown, having their clear input, CLR, connected to a source of $V_{DD}$; their $\overline{G_1}$, $\overline{G_2}$ and $S_1$ inputs tied to circuit ground; their clocking inputs connected to clock line 48, and their $S_0$ inputs tied to shift/$\overline{\text{hold}}$ line 50. Output from MSB shift registers 16, 18 and LSB shift registers 20, 22 appearing on their respective $Q_G$ outputs appear on run length data lines 76, 78 and pel value data lines 80, 82 respectively for input to multiplexer 24. Output from multiplexer 24 appears on pel data lines 84 and 86 for subsequent input to latch 26. The output of latch 26 in response to inputs on pel data lines 84 and 86 appear on pel data output lines 88, 90 respectively. As shown, multiplexer 24 has an active low input terminal, G, connected to circuit ground and a select input, S, connected to the output of NOR gate 34 as will be more fully described hereinbelow. Latch 26 has its clocking input connected to buffered pel clock line 98 and its reset input, R, connected to object go line 54. Output from latch 26 appearing on pel data output lines 88, 90 are connected as inputs to NOR gate 112 having as its output data available line 74. Thus, non-zero data appearing on either or both of pel data output lines 88, 90 will cause an indication on data available line 74.

Output from MSB shift register 16, 18 appearing on run length data lines 76, 78 respectively, are also supplied as input to multiplexer 14 as shown, having an input, 1G, coupled to circuit ground. Output from multiplexer 14 on $Y_0$ line 64 is supplied as one input to quad input NAND gate 32. Outputs from multiplexer 14 appearing on $Y_1$ line 66, $Y_2$ line 68, $Y_3$ line 70 are supplied as input to shift register 12, having its inputs SI, H, F, D, B and A tied to a source of $V_{DD}$. The clocking input of shift register 12 is connected to clock line 48; its clear input, CLR, connected to a source of $V_{DD}$; and its clock inhibit input CK INH connected to circuit ground as shown.

Output from shift register 12 appearing on $Q_H$ line 62 is supplied as another input to quad input NAND gate 32. An additional input to shift register 12 appears on shift/$\overline{\text{load}}$ line 60 at the Q output of flip flop 28.

Quad input NAND gate 32 has as additional inputs buffered delay fill object line 52 and run length/bit mapped control line 58. Output from quad input NAND gate 32 appears on shift/$\overline{\text{hold}}$ line 50 for input to MSB shift register 16, 18; LSB shift registers 20, 22; and the data input, D, of flip flop 28, having its reset input, R, tied to a source of $V_{DD}$ and its set input, S, connected to object go line 54. Clocking input to flip flop 28 appearing on clock data line 56 is also connected to one input of AND gate 30 having its other input connected to load clock line 46 and its output appearing on clock line 48.

Additional inputs to run length coding system 10 are input to 8:1 multiplexer 100 on run length/bit mapped control line 58, zoom factor lines 92, 94 and buffered pel clock input 96. Data inputs to 8:1 multiplexer 100 are supplied on $Q_A$ line 104, $Q_B$ line 106, $Q_C$ line 108 and $Q_D$ line 110 at the output of counter 102. Counter 102 has its clocking input connected to buffered pel clock line 98 and its U/$\overline{\text{D}}$ input connected to a source of $V_{DD}$. $\overline{\text{T}}$, $\overline{\text{P}}$, A, B, C and D inputs to counter 102 are connected to circuit ground as shown. An additional input, L, of counter 102 is connected to object go line 54 which is also coupled to the S input of 8:1 multiplexer 100 through inverter 44 as shown.

Output from 8:1 multiplexer 100 appearing on Y output 72 is supplied as one input to NOR gate 34 having its other input connected to run length/bit mapped control line 58. Output from NOR gate 34 is supplied to the set, S, input of multiplexer 24.

In operation, a signal appearing on clock line 48 at the output of AND gate 30 allows data to be shifted into MSB shift register 16, 18 and LSB shift registers 20, 22. By means of a signal appearing on shift/$\overline{\text{hold}}$ line 50, data may be shifted into, or held within, MSB shift register 16, 18 and LSB shift registers 20, 22 as appropriate. In response to an input to run length coding system 10, on run length/bit mapped control line 58, either run length or bit mapped true objects may be provided. In the bit mapped mode of operation, data appearing on run length data lines 76, 78 and pel value data lines 80, 82 are applied directly to their respective inputs to multiplexer 24 for subsequent input to latch 26 and output therefrom on pel data output lines 88, 90. In the run length coding mode, output from LSB shift registers 20, 22 appearing on pel value data lines 80, 82 are input to multiplexer 24 in the manner above described with respect to the bit mapped mode. In the run length mode of operation, however, output from MSB shift register 16, 18 appearing on run length data lines 76, 78 are utilized as inputs to multiplexer 14 having its outputs applied to quad input NAND gate 32 and shift register 12 as above described. Depending on the inputs to multiplexer 14, an output therefrom provides a decremented countdown from its input count value for applying a hold signal to MSB shift register 16, 18 and LSB shift registers 20, 22 by means of an output of quad input NAND gate appearing on shift/$\overline{\text{hold}}$ line 50. A signal appearing on $Y_0$ line 64 applied directly to quad input NAND gate 32 corresponds to a run length of one while signals appearing on $Y_1$ line 66, $Y_2$ line 68 and $Y_3$ line 70 correspond to run lengths of 3, 5 and 7 respectively. Thus, an active low signal appearing on shift/$\overline{\text{hold}}$ line 50 enables data to be held in MSB shift register 16, 18 and LSB shift registers 20, 22 for the run length determined by the signals appearing on run length data line 76 and 78. This in turn, holds the pel value appearing on pel value data lines 80, 82 at the output of LSB shift registers 20, 22.

Input to run length coding system 10 appearing on buffered delay fill object line 52 signifies that it is time to fill MSB shift registers 16, 18 and LSB shift registers 20, 22 during a horizontal scan of a video display. This signal is delayed due to the fact that the video display generator must compute the address and execute the fetch data from the system DRAM such that the run length coding system 10 may receive data input at the proper time.

A clocking signal appearing on buffered pel clock line 98 is supplied as clocking input to counter 102 and latch 26. Outputs from counter 102 appearing on $Q_A$ line 104, $Q_B$ line 106, $Q_C$ line 108 and $Q_D$ line 110 correspond to division factors of 2, 4, 8 and 16 respectively for input to 8:1 multiplexer 100. Depending on signals appearing on zoom factor lines 92, 94 the size of a true object generated by run length coding system 10 may be altered in either the run length or bit mapped mode of operation.

The output of 8:1 multiplexer 100 appearing on Y output line 72 in conjunction with the signal appearing on run length/bit mapped control line 58 input to NOR gate 34 supply a pel select signal to multiplexer 24. In the bit mapped mode of operation, either the 1B/2B or 1A/2A inputs are selected whereas in the run length mode of operation, the 1A/2A inputs are utilized as will be more fully described hereinafter. Flip flop 28 is utilized to provide a delay of one to enable a reload of MSB shift register 16, 18 and LSB shift registers 20, 22. A "go" signal for generation of a true object is supplied to run length coding system 10 by means of a signal appearing on object go line 54 input to flip-flop 28 and counter 102.

Referring additionally now to FIGS. 2A and 2B, the run length and bit mapped code structure for use with run length coding system 10 are shown. By utilizing run length coding system 10, every true object may be described in one of two ways: either bit mapped encoded or run length encoded. Bit mapped encoding may utilize 14 individually colored pels per video line, whereas run length encoding may utilize seven colors. However, each run length color may be 1, 3, 5, or 7 pels long depending on the values appearing on run length data line 76, 78 as above described. Run length coding provides more flexibility in sizes whereas bit mapped coding provides more flexibility in colors. A choice between run length and bit mapped coding may be made separately for each object in a video display generator wherein each object utilizes its own run length coding system 10. This selection may be made separately for each object utilizing a bit in the object's X coordinate register and depending on the user selection indicated on run length/bit mapped control line 58.

Each four byte packet describes one video line. The more significant nibble of the first byte of each packet contains an active low last line bit, LL, and a three bit color mapping RAM (CMR) offset. The least significant nibble of the first byte of each packet provides the beginning of the data for the video line. If the last line bit, LL, is clear, the rest of the line is ignored. If this bit is set, the three bit CMR offset is used for the most significant bits of the CMR address. As can be seen in a comparison of the code structures of FIGS. 2A and 2B, the meaning of the following three and one-half bytes is different for the run length and bit mapped code structure but they both use two bits for each color selection therefore rendering four choices. In a video display generator incorporating a run length coding system 10, a color choice of ØØ may make the pels transparent so that whatever the object passes over can show through. Since transparent pels are not deemed to collide with any other object, the user can define functional as well as visible shapes by putting transparent pels around a small visual object. The remaining three color choices (Ø1, ØØ, 11) will utilize the three-bit CMR offset in the video line data's first nibble to establish the pel's CMR address. Each line can have three visible colors, and, because each line has its own CMR offset, each object can have 24 colors. The eight CMR addresses ending in ØØ are replaced by a transparency, so they are not available for true objects.

In run length encoding of a true object, each nibble describes a line segment. The most significant two bits select a line length: a code of ØØ means one pel, Ø1 means three pels, 1Ø means five pels, and 11 means seven pels. The least significant two bits of the nibble select the color as above described.

A video line's four byte packet is run length encoded as shown in FIG. 2A. In bit mapped encoding the three and one-half bytes of video data following the last line bit and CMR offset are treated as 14 two-bit colors. Each two-bit color describes one pel, so a bit plane object is 14 pels wide.

A bit mapped encoded video line packet is arranged as shown in FIG. 2B.

What has been provided therefore is an improved system and method for generation of true objects in a video display generator. The true object generation system and method of the present invention minimizes on chip hardware storage area and, hence, access time for a given object size. Moreover, the improved system and method for generation of true objects herein provided provides for either run length or bit mapped coding of true objects.

While there have been described above the principles of the invention in conjunction with specific apparatus, it is to be clearly understood that this description is made only by way of example and not as a limitation to the scope of the invention.

I claim:

1. A true object generation system, capable of operation in a run length or bit mapped mode, for true object generation in a video display generator comprising:

shift register means, coupled to a source of data, for selectively receiving therefrom (a) bit mapped data and (b) object run length and pel value data;

first means, coupled to said shift register means and responsive to said object run length data for holding said pel value at said shift register means output for a time proportional to said object run length; and second means, coupled to said shift register means, for switching said true object generation system between said bit mapped mode and said run length mode.

2. The true object generation system of claim 1 wherein said shift register means operates in response to a shift/hold signal from said first means.

3. The true object generation system of claim 1 wherein said first means comprises a counter set in response to said object run length data.

4. The true object generation system of claim 3 wherein said counter comprises a multiplexer coupled to a shift register.

5. The true object generation system of claim 1 further comprising a multiplexer, coupled to said shift register means, for receiving said object run length and pel value data.

6. The true object generation system of claim 5 further comprising a latch, coupled to said multiplexer, for holding an output from said multiplexer.

7. A true object generation system, capable of operation in a run length or bit mapped mode, for true object generation in a video display generator comprising:

a first shift register, coupled to a source of data, for selectively receiving therefrom (a) bit mapped data and (b) object run length and pel value data;

first means, coupled to said first shift register and responsive to said object run length data for establishing a count value proportional to said object run length;

second means, coupled to and responsive to said first means, for decrementing from said count value, said second means coupled to said first shift register for applying a hold signal to said first shift register during a countdown from said count value and for applying a shift signal to said first shift register when said countdown is complete; and third means, coupled to said first shift register, for switching said true object generation system between said bit mapped mode and said run length mode.

8. The true object generation system of claim 7 wherein said first means comprises a run length multiplexer.

9. The true object generation system of claim 7 wherein said second means comprises a second shift register.

10. The true object generation system of claim 7 further comprising a multiplexer for receiving said object run length and pel value data.

11. The true object generation system of claim 10 further comprising a latch, coupled to said multiplexer, for holding an output from said multiplexer.

* * * * *